United States Patent [19]

Lundgren

[11] 4,312,092

[45] Jan. 26, 1982

[54] MOP HEADS

[76] Inventor: Lars Lundgren, Teleskopgatan 9, S-552 61 Jönköping, Sweden

[21] Appl. No.: 160,454

[22] Filed: Jun. 18, 1980

[30] Foreign Application Priority Data

Jun. 20, 1979 [SE] Sweden ..... 7905415

[51] Int. Cl.[3] ..... A47L 13/14

[52] U.S. Cl. ..... 15/119 A; 15/228

[58] Field of Search ..... 15/116 R, 116 A, 119 R, 15/119 A, 228, 229, 244 R

[56] References Cited

U.S. PATENT DOCUMENTS

| | | | |
|---|---|---|---|
| 2,665,438 | 1/1954 | Insley | 15/229 BP X |
| 2,670,488 | 3/1954 | Richards et al. | 15/119 A |
| 2,757,398 | 8/1956 | Richards et al. | 15/119 A |
| 2,779,959 | 2/1957 | Hvale | 15/119 A |

FOREIGN PATENT DOCUMENTS

| | | | |
|---|---|---|---|
| 302670 | 7/1968 | Sweden | 15/119 A |

*Primary Examiner*—Robert L. Bleutge

*Attorney, Agent, or Firm*—Cushman, Darby & Cushman

[57] ABSTRACT

A mop head comprises a central member which is rotatably secured to a swing arm, and two panels which are pivotably connected to the central member. For pivoting the panels on axes which are substantially parallel to the rotational axis of the swing arm there is provided a substantially V-shaped yoke which is connected to the central member and manually pivotable on an axis which is substantially perpendicular to said axes. At its rotational movement, the shanks of the yoke are pressed against a marginal portion of each panel and hereby rotate the panels. The pressure of the yoke against the panels entails a risk for displacement of the panels in the direction of their axes of rotation to such an extent that the engagement between the panels and their bearing means comprised in the central member is released. To eliminate this risk each panel has a cam surface which cooperates with and engages behind an associated blocking surface provided on the central member.

3 Claims, 3 Drawing Figures

MOP HEADS

BACKGROUND OF THE INVENTION

This invention relates generally to mops and especially to an improvement in mop heads of the kind set forth in the preamble of claim 1.

Mops of this kind comprise an elongated rodlike handle which is rotatably connected to the mop head by means of the swing arm to make possible pivoting down of the handle sidewards, so that it will become easier to get the mop introduced under cupboards and other pieces of furniture having short legs. Examples of such mops are disclosed in the U.S. Pat. No. 2,757,398 and (particularly) in the Swedish Pat. No. 302 670. Mop heads of similar kinds are disclosed in the French Pat. No. 1 226 647 and the U.S. Pat. No. 2,779,959.

The panels which are swingable on pivot axes, which are defined by mutually coaxial pins and preferably are distant from and parallel to each other, are pivoted or rotated towards each other for squeezing the sponge or the like by means of a wringer rod having its one end secured to a sleeve, which can be (manually) displaced along the mop handle, and having its other end connected by means of a T-piece or the like to the central portion of a substantially V-shaped yoke, whose two shank ends are bent through an angle of about 90° and rotatably journaled in the central member of the mop head. When manually displacing the wringer rod towards the mop head by means of the sleeve, the yoke is rotated in relation to the mop head, whereby the shanks of the yoke are pressed against and slide along such marginal portions of the panels as face the mop handle, said panels becoming hereby rotated towards each other.

The pressure from the yoke against the panels, however, tends to displace the latter in the direction of their pivot axes, whereby the risk arises that the panels will get freed from their pivot pins. In view hereof the principal object of the invention is to eliminate this risk.

Another object of the invention is to provide a mop head which comprises very few parts and is so constructed that the mounting of its components is greatly facilitated.

SUMMARY OF THE INVENTION

The above objects are attained thanks to the fact that the central member of the mop head according to the invention is provided with a bearing casing, in which said swing arm is journaled, and in that two blocking surfaces are provided on the bearing casing and a cam surface is provided on each panel for cooperation with and abutment against an individual one of said blocking surfaces to hereby prevent displacement of said panels in the direction of their pivot axes during the swinging movement of he panels, and that a torsion spring which is common to both of said panels is journaled on a swing arm stub portion located in the central member.

BRIEF DESCRIPTION OF THE DRAWINGS

Further features and advantages of the improvement according to the invention will become apparent from the following detailed description and the annexed drawings which diagrammatically and as non-limiting examples illustrate a preferred embodiment of the invention and in which such details as are immaterial in the context have been omitted.

Figure 1:
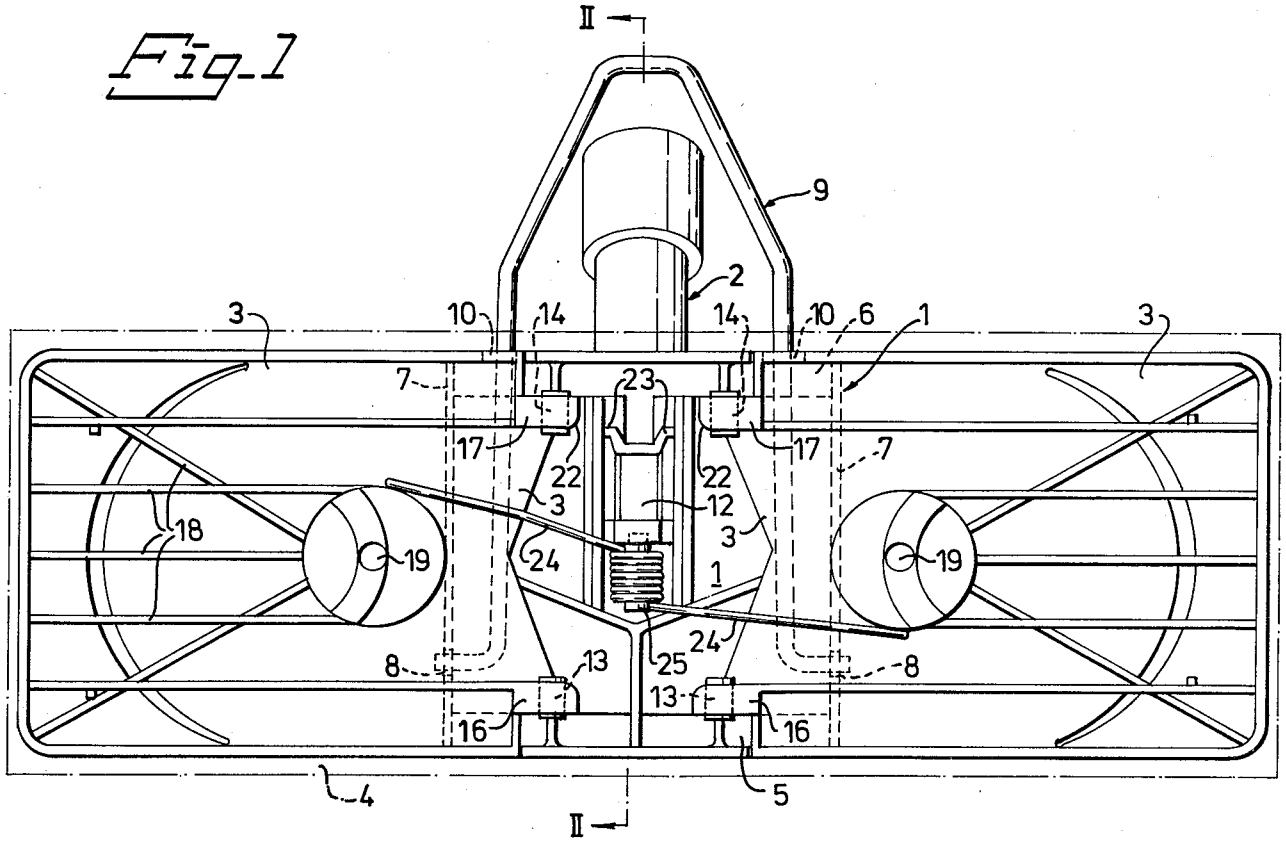
FIG. 1 is a bottom plan view of the mop head without its sponge or pad which is indicated merely by a dash-dot contour line.
Figure 2:
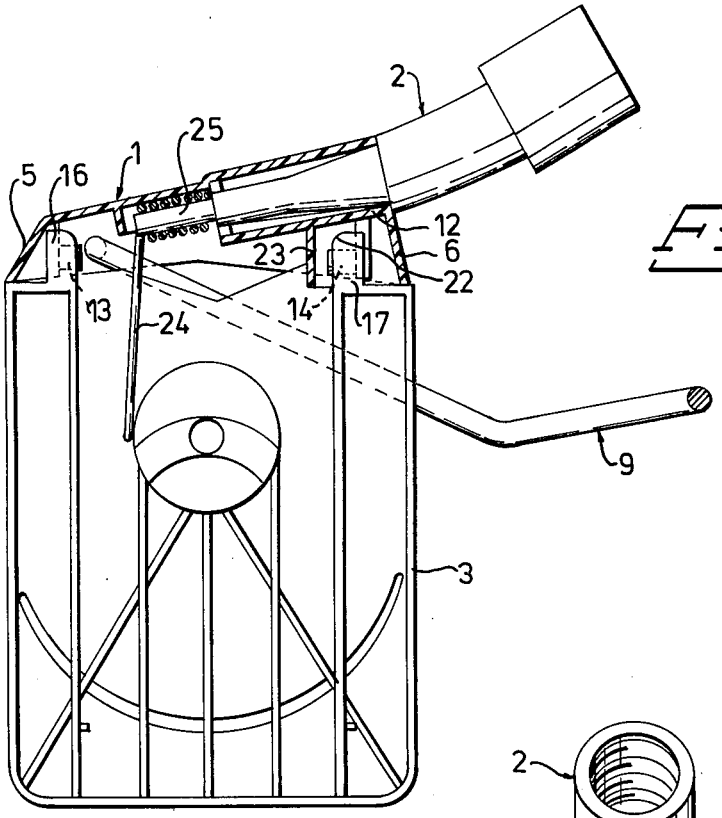
FIG. 2 is a cross sectional view on line II—II in FIG. 1, the single visible panel being swung up into a light wringing or squeezing position.
Figure 3:
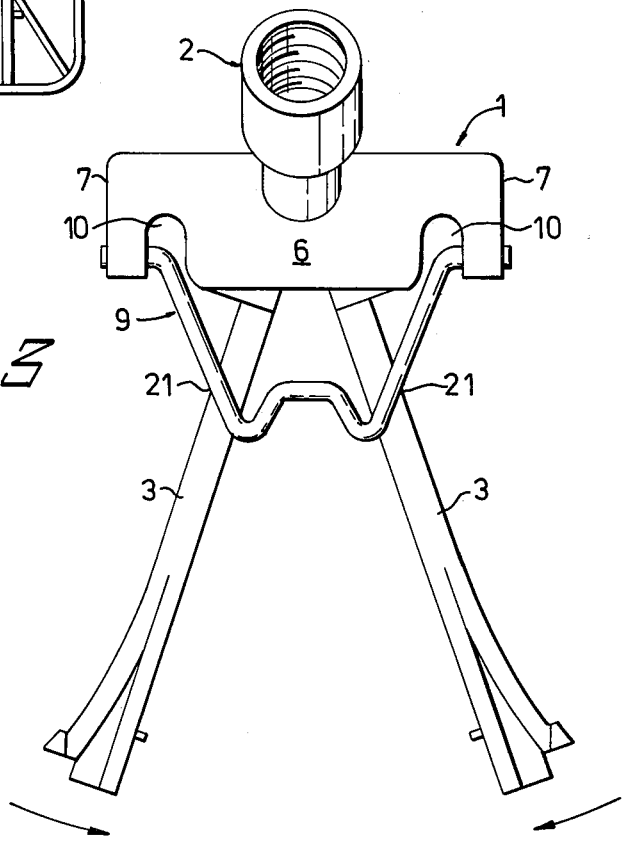
FIG. 3 is an end elevation, corresponding to FIG. 2, of the mop head.

The principal components of the mop head according to the invention are a central member generally designated by the reference numeral 1, a swing arm 2, two swingable panels each generally designated by 3, and a sponge or pad of water absorbing material 4 which is merely indicated by a dash-dot contour line in FIG. 1 to make the underlaying details visible. The central member 1 is rectangular in the illustrated embodiment as seen in a plan view and has a folded-down front edge 5 (located at the remote side of the mop as seen by the operator in the use position of the mop), a rear edge 6, which is higher than the front edge, and two lateral edges 7. The two lateral edges have each an aperture 8 which are coaxial with each other and constitute bearing means for a yoke 9 which is also comprised in the mop head. The yoke 9 is substantially V-shaped as seen in plan view as well as in side view, excepting the yoke shank ends which engage the apertures 8 and are bent outwards, away from each other through an angle of about 90°. The rear edge of the casing has a pair of recesses 10 which are most clearly shown in FIG. 3 and into which the shanks of the yoke engage in the use position of the mop.

The central member 1 also comprises bearing means which are generally designated by 12 and are more explcitly described in the following and by means of which the swing arm 2 is rotatably and substantially non-displaceably connected to the central member 1. The latter also comprises two front pivot pins 13 and two rear pivot pins 14 for the panels 3.

Each panel 3 has a fore bearing ear 16 and a rear beasing ear 17 which are coaxial with each other and are journaled on the pivot pins 13 and 14 respectively of the central member 1. The two panels 3 are alike and mutually interchangeable and consist in the illustrated embodiment of a plastic which is resilient in a heated condition. According to one aspect of the invention the panels are mounted in a heated condition, the two fore bearing ears 16 (and/or the rear ones 17) being first bent out to such an extent that they get clear of the pins 13 and being subsequently bent back, so that the pins penetrate into their respective bearing ears. On its underside which faces the sponge or the like, the panels 3 preferably have a pattern or lattice of ribs or the like 18 which prevent the sponge from displacing or distorting itself.

The sponge or the like 4 which preferably is exchangeable may be secured to the panels in any suitable manner, e.g. by rings or the like (not shown) of metal wire which are inserted in blind cut-outs in the sponge and are provided with threaded studs which pass through holes 19 in the panels and cooperate with threaded washers or the like (not shown) which releasably hold the rings or the like and consequently also the sponge secured to the panels 3.

At that end of the swing arm 2 which is remote from the central member 1, the swing arm is secured, e.g. by means of a threaded connection, to a mop handle (not shown) on which a sleeve or the like (not shown) may be displaced manually. Through a wringer rod and a T-piece, which are not shown in the drawings either, this sleeve is connected to the central portion of the V-shaped yoke 9 as indicated already in the opening paragraphs of the description. When the sleeve and the wringer rod are manually displaced downwardly along the mop handle towards the mop head, the yoke 9 is swung down-wards on its rotational axis defined by the apertures 8 and moves out from the recesses 10 and presses against the rear marginal or edge portion of the panels 3, so that the panels are swung downwards on their rotational axes defined by the pivot pins 13, 14 according to the arrows in FIG. 3 and squeeze the water out of the sponge 4. The moving points of engagement between the yoke 9 and the panels 3 is designated by 21 in FIG. 3.

On account of the pressure of the yoke 9 upon the rear marginal portions of the panels 3 a risk is created that the bearing ears 17 might loose their grip on the rear pins or studs 14. To eliminate this risk the bearing ears according to the invention have been designed with special cam surfaces 22 which cooperate with and engage behind a pair of arresting or blocking surfaces 23 provided on and projecting from the bearing casing of the swing arm 2. These blocking surfaces may constitute a common wall or be integral in another way as in the illustrated embodiment, but they may also be designed in any other suitable way.

According to a further feature of the invention the two panels 3 are biased to an extended or folded-out position, in which the panels are located in a common plane, by means of one single torsion spring 24 of the helical type which is common to both panels. In the preferred and illustrated embodiment this spring 24 is positioned on and surrounds a stud-shaped elongation 25 of that end of the arm which is remote from the mop handle, said elongation being located in the central member 1.

The embodiment described above and illustrated in the drawings is, of course, to be regarded merely as a non-limiting example and may as to its details be modified in several ways within the scope of the following claims. For example, the bearing ears 16, 17 of the panels 3 may change places with their bearing studs or pins.

What I claim is:

1. Improvement in mop heads comprising a central member, a swing arm pivotably connected thereto, a pair of spring biased panels substantially symmetrically located in relation to said swing arm, bearing means by means of which said panels are connected to said central member in such a way, that they are pivotable on axes which are substantially parallel to the pivot axis of the swing arm, means for simultaneous rotating the panels in mutually opposite directions, and a water absorbing pad which is secured to said panels in such a way that it is bent and compressed between said panels through simultaneous rotation of the panels towards each other, wherein said central member is provided with a bearing casing in which said swing arm is journaled, and two blocking surfaces are provided on said bearing casing, and a cam surface is provided on each panel for cooperation with and abutment against an individual one of said blocking surfaces, to hereby prevent displacement of said panels in the direction of the pivot axes of said panels during their rotational movement, and wherein a torsion spring, which is common to both of said panels, is journaled on a swing arm stub portion in said central member.

2. Mop head according to claim 1, wherein said central member is provided with a pair of pivot pins, and each panel has a bearing ear which is journaled on an individual one of said pivot pins, said cam surfaces being provided on said bearing ears.

3. Mop head according to claim 1, wherein each panel, which is of plastic, has a pair of bearing ears which are journaled on a pair of mutually coaxial pivot pins comprised in said central member, and wherein at least one of said bearing ears is threaded upon its pivot pin in a hot and on account hereof resilient condition.

* * * * *